United States Patent [19]

Fischer

[11] Patent Number: 4,596,184

[45] Date of Patent: Jun. 24, 1986

[54] PRINTED SHEET TRANSPORT APPARATUS

[75] Inventor: Hermann Fischer, Augsburg, Fed. Rep. of Germany

[73] Assignee: M.A.N.-Roland Druckmaschinen Aktiengesellschaft, Fed. Rep. of Germany

[21] Appl. No.: 762,139

[22] Filed: Aug. 2, 1985

[30] Foreign Application Priority Data

Aug. 7, 1984 [DE] Fed. Rep. of Germany ..... 3429008

[51] Int. Cl.[4] ..... B41F 21/08

[52] U.S. Cl. ..... 101/232; 101/408

[58] Field of Search ..... 101/232, 233, 234, 235, 101/236, 237–242, 408, 409, 410, 411, 246, 183; 271/6, 7, 69, 204, 205, 206

[56] References Cited

U.S. PATENT DOCUMENTS

| | | | |
|---|---|---|---|
| 2,940,387 | 6/1960 | Pritchard | 101/183 |
| 3,334,897 | 8/1967 | Sharkey | 271/204 X |
| 4,222,326 | 9/1980 | Mathes | 101/232 X |

*Primary Examiner*—J. Reed Fisher

*Attorney, Agent, or Firm*—Frishauf, Holtz, Goodman & Woodward

[57] ABSTRACT

To prevent the formation of ghosts as sheets are pulled off a delivery drum (1) by a transport chain arrangement, the gripper mechanism (3–6) on the chain transport is movably located thereon to impart forward movement to the gripped sheet in addition to the movement of the chain and so that tension on the sheet is continuously maintained. The mechanism for imparting said additional movement includes a holding bracket (12) secured to the chain (2) on which a carrier plate (13) is secured, the carrier plate being movable with respect to the holding bracket and retaining the gripper mechanism. The carrier plate can be moved by an angled cam follower lever (15) secured to the holding bracket and pushing the carrier plate, and hence the gripper mechanism, forwardly in the direction of movement of the chain when the cam follower lever is engaged by a suitably positioned cam.

10 Claims, 3 Drawing Figures

PRINTED SHEET TRANSPORT APPARATUS

The present invention relates to apparatus to transport printed sheets, and particularly to apparatus which receives printed sheets directly from a sheet delivery drum which may form part of a printing system, to transport printed sheets away from the drum.

BACKGROUND

Various types of sheets transport apparatus are known, and one such system includes a chain or belt system in which spaced grippers grip the leading edge of printed sheets being delivered thereto from a delivery drum. Apparatus of this type is described, for example, in the textbook "Einführung in den Offsetdruck" ("Introduction to Offseet Printing"), by Wolfgang Walenski, 1975, page 96. As shown in this textbook, sheets are transferred from a cylinder of a printing system to a gripper chain system. Upon such transfer, a reduction in speed of movement of the sheets will occur as soon as the chain gripper system leaves the radius of the drum behind the delivery drum, or the last drum, or cylinder of the printing machine. As a consequence, the trailing end of the printed subject matter may still be located between two printing cylinders, operating at a higher linear speed than the transport drum or chain. The trailing end of the sheet, thus, will move faster than the leading edge which is in the transport chain system.

It has been found in practice that such a system may result in ghost printing at the trailing edge of the sheet. The reason, apparently, is that no tension is applied to the sheet by the cross bars, with the grippers, gripping the leading edge, and operating at a linear speed less than the circumferential speed of the printing cylinders. This undesirable effect is enhanced if the diameter of the delivery drum is less than the diameter of one of the cylinders of the printing system and, particularly, the printing or impression cylinder.

The problem is not serious in printing machines which are constructed in serial form, that is, one printing system behind another; it is, however, sometimes annoying if a chain transport apparatus is combined with a five-cylinder printing machine. In such apparatus, the quality of print, particularly at the trailing edge of the sheet, may be impaired. It appears that the reason therefor is that, after transfer of the sheet to the chain gripper system, the trailing edge of the sheet will still be located between two printing or impression lines, that is, for example between two blanket cylinders and the impression cylinder. The tension forces acting on the sheets are not applied from the leading edge, and the differential sheet travel along one of the blanket cylinders, upon being passed along the second blanket cylinder, will lead to the above referred-to ghosts, which is more noticeable as the edge of the sheet is approached.

THE INVENTION

It is an object to so guide printed sheets by grippers of a chain transport system that the formation of ghosts, particularly at the trailing edge of the sheet, is eliminated.

Briefly, the holding gripper system on the transport chain or belt is attached to an auxiliary carrier plate which is movable with respect to the transport chain or belt and, in the region of pick-up of the sheet from the delivery drum or cylinder of a printing system, is additionally moved in the direction of travel of the chain so that the sheet is positively moved faster than the transport speed of the chain at that instant. The additional speed component can be obtained by locating the gripper system on a carrier plate which is movably secured to the chain or belt and controlled to travel ahead of a rest position on the chain or belt, for example under control of a cam, at the at the time when the sheet should have a travel speed faster than the average speed of the chain or belt.

DRAWINGS

Figure 2:
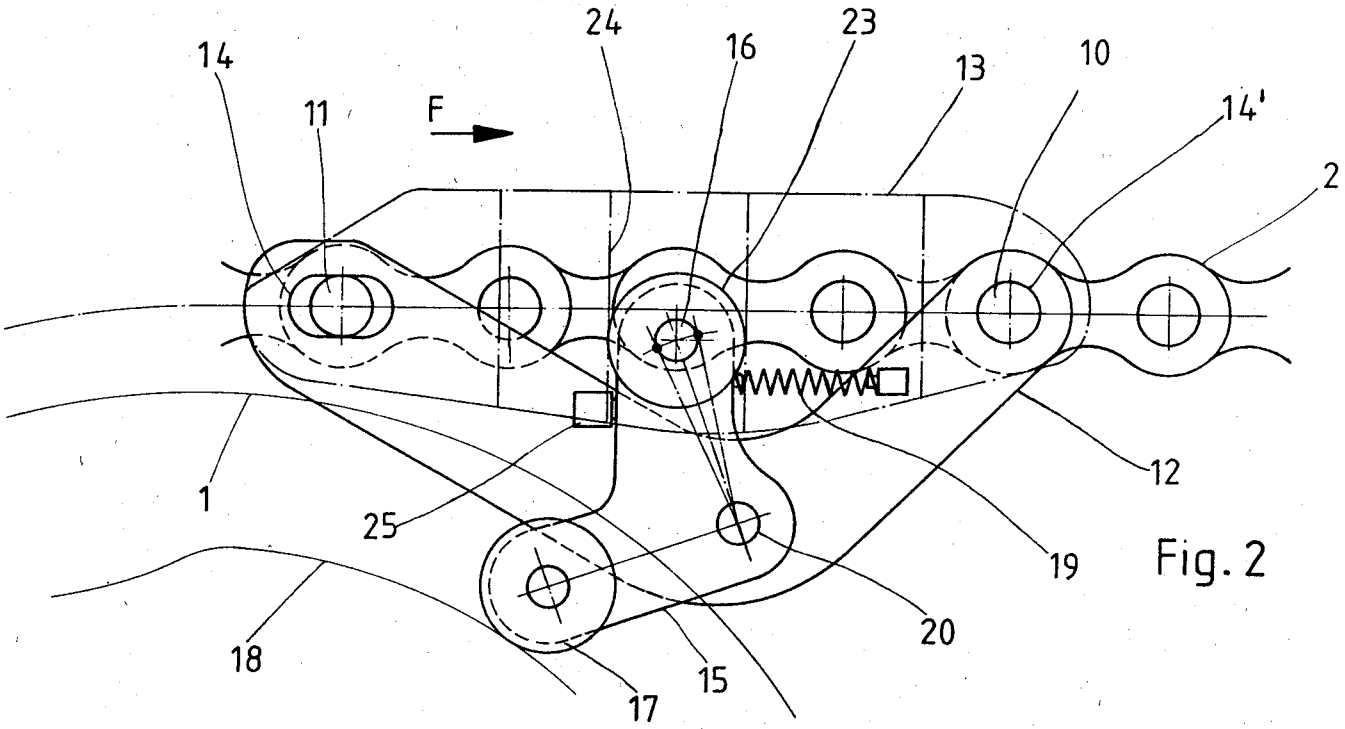
FIG. 2 is a cross-sectional view along line II—II of FIG. 1.

A sheet delivery drum 1 (FIG. 2) which may, for example, be part of a five-cylinder printing system, has a sheet removal chain 2 located close thereto. Cross bars, rods or spindles 3, 4 extend between the chain 2 and another chain—not shown—transversely across the cylinder 1. This sytem is conventional. As well known, one of the cross elements forms an engagement spindle 3, and the other a gripper support spindle 4 (see FIG. 3). The cross elements 3, 4 each carry spaced grippers having gripper tongues 6 engaging in gripper surfaces 5 formed on the engagement spindles 3. The tongues 6 are rotatable, for example with the spindle 4. As customary, and well known, rotation of the gripper spindles 4 causes rotation of the gripper tongues 6 in order to, respectively, grip or release the leading edge of a sheet. A control cam follower roller 7, engaging a cam track—not shown—controls rotary or rocking movement of the spindle 4 and hence of the tongue 6. This arrangement is well known.

In accordance with the present invention, an apparatus is provided to so secure the gripper system formed by the spindles 3, 4 and the engagement surfaces and elements 5, 6 that it can travel with respect to the chain and thus introduce an additional speed component to sheets being gripped by the grippers.

Figure 1:
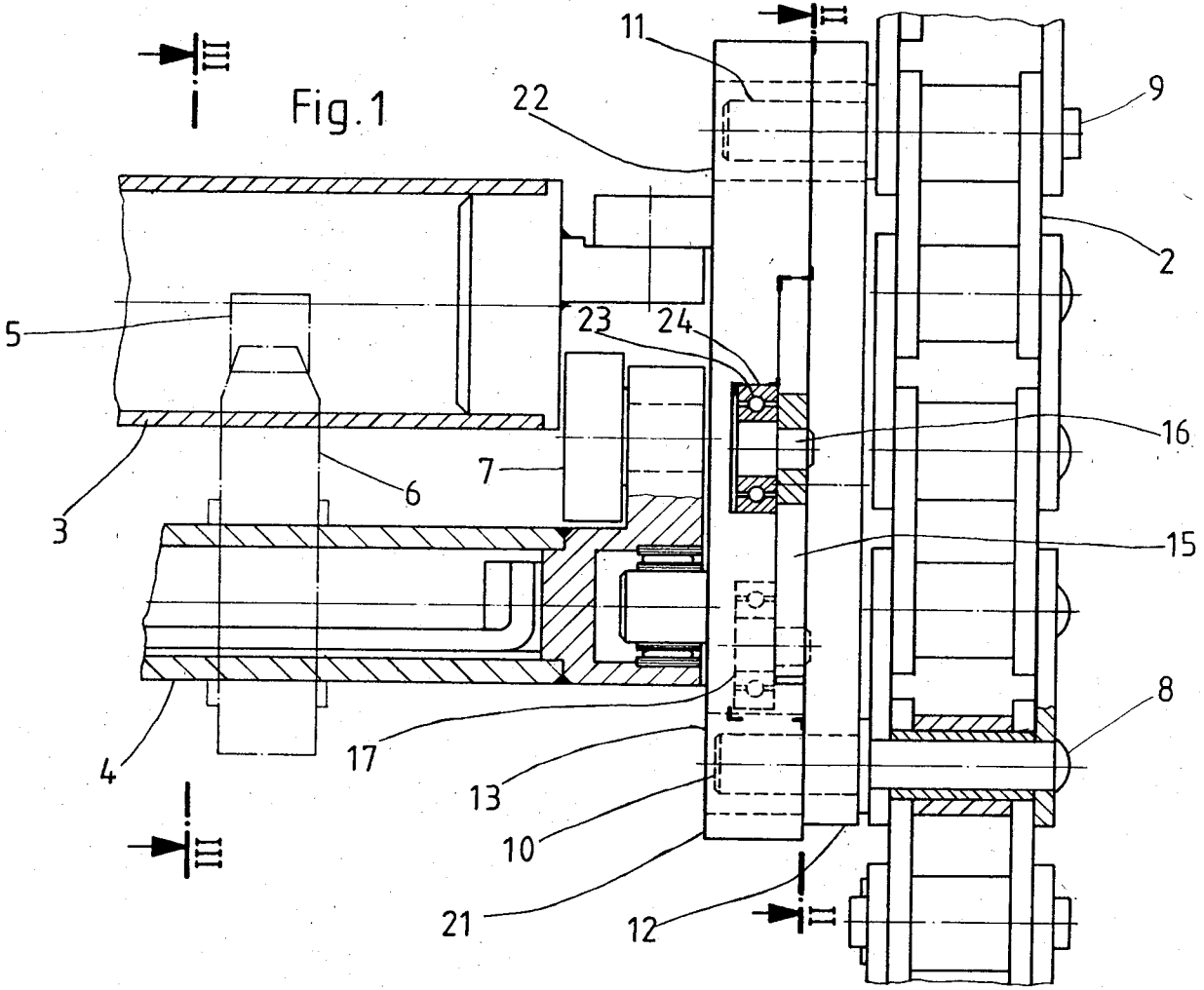
FIG. 1 is a schematic cross section of the lateral guidance and attachment system of a gripper arrangement on a transport chain, in which only one side of a chain pair is shown, for simplicity.

Referring to FIG. 1: The transport chain 2 has chain bolts 8, 9 extended laterally beyond the chain. These chain bolts connect, for example, each two spaced chain links. The bolts 8, 9 are extended outwardly to form bolts 10, 11—or have separate bolts 10, 11 secured thereto. The bolts 10, 11 extend inwardly of the apparatus, that is, in the direction of the cross elements 3, 4. A connecting bracket 12 is located adjacent the chain, and essentially parallel thereto, on which a carrier plate 13 is secured. The bracket 12—see FIG. 2—is formed at its left side (with respect to FIG. 2) with an elongated hole 14; bolt 11 engages in the hole 14. At the right side, the bracket 12 is formed with a bore 14' which is engaged by the bolt 10. An angled lever 15, formed at its upper end with a bolt 16, and at its lower with a cam follower roller 17, is engageable by a cam track of a cam 18. The angled lever 15 is biassed in counterclockwise direction by a compression spring 19. When the cam follower 17 engages the cam track of cam 18, the lever 15 is deflected in clockwise direction. Cam 15 is located fixed in space adjacent or behind the delivery drum 1.

Elongated holes 21, 22 are formed in the carrier plate 13, and located adjacent the elongated hole 14 of the bracket 12 and adjacent the bore 14' of the bracket 12.

Figure 3:
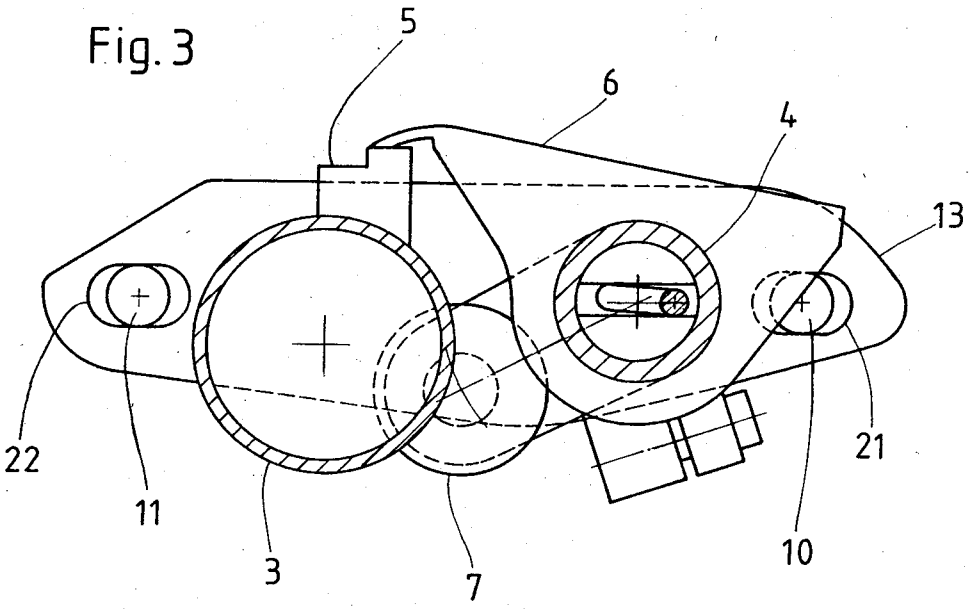
FIG. 3 is a cross-sectional view along line III—III of FIG. 1.

The bolts 10, 11 engage in the elongated holes 21, 22—see FIG. 3. A roller 23 is secured to that bolt 16, located at the upper end of the control or angled lever 15. The roller 23 engages in a recess or groove 24, extending transversely to the transport direction indicated by arrow F of the chain 2, and formed in the carrier plate 13.

The cross elements 3, 4 are secured to the carrier plate 13.

Operation: Let it be assumed that the grippers 5, 6 have seized the leading edge of a sheet coming from the printing station. The cam follower 17 will engage the cam 18 located on or behind the delivery drum 1. As the cam follower rides on the rising or land portion of the cam 18, it will be deflected in clockwise direction. This causes the roller 23, located in the groove 24, to carry along the carrier plate 13 in clockwise direction, that is, in transport direction F of the chain 2. Since the cross elements 3, 4 are secured to the carrier plate 13, they, likewise, will be moved in clockwise direction with respect to the chain 2.

The system simply and readily insures that the leading edge of the sheet which is derived from the printing system will receive an acceleration or additional speed component in addition to the transport speed of the chain 2. The extent of acceleration and/or additional speed can readily be controlled by suitable shaping of the curve of the cam 18. The engagement with the cam 18 by the cam follower 17 may continue until the trailing edge of the sheet has passed beyond the printing or impression line. The cam track 18 need not be fixed in space but could rotate with the cylinder 1.

After the cam follower 17 has left the land portion of cam 18, compression spring 19 moves the lever 15, and hence plate 13 and with it the cross elements 3, 4 counter the direction of transport F of the chain. Since, at that time, printing has been completed, a retardation or deceleration of the leading edge of the sheet will no longer undesirably affect printing quality. In actual practice, an additional path length of from between 1 to $1\frac{1}{2}$ cm is sufficient in order to prevent unsharp printing or the formation of ghosts at the trailing edge of the sheet.

Shift of the carrier plate 13 in a direction of movement of the chain 2—see arrow F—is permitted by the elongated holes 21, 22 in the carrier plate 13. These elongated holes also permit slight deflection of the section between the holes 21, 22 of the chain 2. This slight deflection is permitted by the elongated hole formed on the bracket 12, that is, the hole 14 at the left side (FIG. 1). The angled lever 15 itself is rotatable about the bolt 20 and secured to the bracket 12.

A limit or stop element 25 is provided which limits the pivoting movement of the lever 15 in counterclockwise direction, so that roller 17, as it leaves the curve 18, will have a limited degree of travel.

Various changes and modifications may be made within the scope of the inventive concept.

I claim:

1. For combination with a printing machine, a printed sheet transport apparatus having a sheet delivery drum (1);

a sheet transport chain or belt (2) positioned for receiving freshly printed sheets from the delivery drum (1); and a gripper mechanism (3–6) carried by the sheet transport chain or belt (2), wherein, in accordance with the invention, the gripper mechanism comprises a holding bracket (12) secured to the chain or belt (2) and extending essentially parallel to the transport direction (F) of the chain or belt;

means (10, 11) for movably and rockably retaining the holding bracket (12) on the chain or belt;

a carrier plate (13) secured to said holding bracket (12) and movably and rockably retained on said holding bracket;

a cam (18) positioned in fixed relation to the sheet delivery drum and having a cam track formed thereon;

a cam follower lever (15) movably retained on the holding bracket (12) and having a first lever arm engaging the cam track and a second lever arm engaging the carrier plate;

a gripper holding bar (3, 4) and means (5, 6) for clamping the leading edge of the sheet in and on the holding bar, wherein said gripper holding bar (3) and said clamping means are secured to the carrier plate (13), and the cam track is positioned and arranged, when the transport chain or belt (2) carries the holding bracket (12) and with it the cam follower lever (15) past the delivery drum, to cause the cam follower lever (15) to deflect and impart to said gripper holding bar (3) an additional movement in the direction of movement (F) of the chain or belt to introduce an additional movement to the leading edge of a sheet clamped against the gripper holding bar superimposed upon the movement of the chain or belt.

2. Mechanism according to claim 1, wherein the means for movably and rockably retaining the holding bracket (12) on the chain or belt comprises bolts (10, 11) extending transversely with respect to the direction of the chain or belt, and at least one elongated hole (14) in the bracket and engaged by one (11) of said bolts;

and wherein the carrier plate (13) is formed with two elongated holes (21, 22), one, each, engaging one of said bolts (10, 11).

3. Mechanism according to claim 2, wherein two bolts (10, 11) are provided, positioned spaced from each other along the length of said chain or belt.

4. Mechanism according to claim 3, wherein said sheet transport chain or belt (2) comprises a link chain, and said bolts are positioned to form connecting bolts of spaced links.

5. Mechanism according to claim 1, wherein the cam follower lever (15) comprises a two-arm lever, one arm engaging the carrier plate and the other arm engaging said cam (18).

6. Mechanism according to claim 5, wherein said carrier plate is formed with a groove or elongated recess (24) and said one arm of the cam follower lever is engaged (23) in said recess.

7. Mechanism according to claim 1, further including a biassing spring (19) acting on the cam follower lever and biassing the cam follower lever in a direction counter the direction of movement (F) of the chain or belt.

8. Mechanism according to claim 1, wherein the chain is a link or sprocket chain;

and the means (10, 11) for movably and rockably retaining the holding bracket (12) comprises extension bolts (10, 11) extending from link connecting bolts (8, 9) of the link or sprocket chain.

9. Mechanism according to claim 1, further including a stop element (15) positioned for limiting deflecting movement of the cam follower lever when the cam follower lever is disengaged from the cam track.

10. Mechanism according to claim 9, wherein said stop element is located on the holding bracket (12) and limits the movement of the cam follower lever in a direction counter the biassing direction of a spring (19) biassing the cam follower lever (15) for engagement with the cam (18).

* * * * *